US006377771B1

(12) United States Patent
Verluyten et al.

(10) Patent No.: US 6,377,771 B1
(45) Date of Patent: Apr. 23, 2002

(54) PRINTER INCLUDING A MOVING IMAGE-CARRYING BELT

(75) Inventors: Ludo Verluyten, Holsbeek; Jan De Bock, Melsele, both of (BE)

(73) Assignee: Xeikon NV, Mortsel (BE)

( * ) Notice: Subject to any disclaimer, the term of this patent is extended or adjusted under 35 U.S.C. 154(b) by 0 days.

(21) Appl. No.: 09/633,270

(22) Filed: Aug. 4, 2000

(30) Foreign Application Priority Data

Aug. 7, 1999 (GB) ..... 9918585

(51) Int. Cl.[7] ..... G03G 15/01
(52) U.S. Cl. ..... 399/302; 399/299
(58) Field of Search ..... 399/299, 300, 399/302, 307, 308

(56) References Cited

U.S. PATENT DOCUMENTS 5,409,557 A * 4/1995 Mammino et al. ..... 399/302
5,438,398 A 8/1995 Tanigawa et al.
5,778,291 A 7/1998 Okubo et al.
5,805,967 A 9/1998 De Bock et al.
5,823,017 A 10/1998 Hapke et al.
6,088,565 A * 7/2000 Jia et al. ..... 399/302

FOREIGN PATENT DOCUMENTS

| | | |
|---|---|---|
| EP | 0 629 927 A2 | 12/1994 |
| EP | 0 760 495 A2 | 3/1997 |
| JP | 8-202064 A | 8/1996 |
| JP | 11-024429 | 1/1999 |

* cited by examiner

*Primary Examiner*—Arthur T. Grimley
*Assistant Examiner*—Hoang Ngo
(74) *Attorney, Agent, or Firm*—Larson & Taylor PLC

(57) ABSTRACT

The printer includes a moving image-carrying belt, and a plurality of toner image producing stations for sequentially depositing a plurality of toner images in register with each other on the surface of said image-carrying belt to form a composite toner image thereon. The image-carrying belt is formed of an electrically non-conductive material having a mean volume resistivity of from $10^8$ to $10^{11}$ ohm m.

12 Claims, 2 Drawing Sheets

PRINTER INCLUDING A MOVING IMAGE-CARRYING BELT

FIELD OF THE INVENTION

The present invention relates to printers, in particular printers of the type including a moving image-carrying belt, and a plurality of toner image producing stations for sequentially depositing a plurality of toner images in register with each other on the surface of the image-carrying belt to form a composite toner image thereon.

BACKGROUND OF THE INVENTION

U.S. Pat. No. 5,805,967 (De Cock et al./Xeikon NV) describes a single pass, multi-color electrostatographic printer. A plurality of toner images of different colors are electrostatically deposited sequentially in powder form in register with each other from a plurality of printing stations onto an image-carrying member which is in the form of a intermediate transfer belt. The so-formed composite toner image is then transferred to a silicone coated metal transfer belt which is brought into contact with a substrate. The composite toner image is thereby transferred to the substrate.

The intermediate transfer belt may have a toner image-carrying surface formed of an electrically non-conductive material selected from polyethylene terephthalate, silicone elastomer, polyimide (such as KAPTON—Trade Mark), and mixtures thereof.

It has been found that where several toner images are transferred electrostatically to the intermediate transfer belt, some distortion of the composite image may occur upon transfer to the transfer belt, revealing itself in badly transferred areas in the final printed product.

SUMMARY OF THE INVENTION

It is an object of the present invention to provide a printer of the type described in which these disadvantages can be overcome.

We have discovered that this objective, and other useful advantages, can be obtained when the image-carrying belt is formed of a non-conductive material having specified electrical properties.

According to the invention there is provided a printer including a moving image-carrying belt, and a plurality of toner image producing stations for sequentially electrostatically depositing a plurality of toner images in register with each other on the surface of the image-carrying belt to form a composite toner image thereon, wherein the image-carrying belt is formed of an electrically non-conductive material having a mean volume resistivity of from $10^8$ to $10^{11}$ ohm m.

In a preferred embodiment of the invention, the printer also includes a transfer member for transferring the composite image from the image-carrying belt to a substrate.

While not wishing to be bound by theory, we believe that in the case of a multi-color printer in which a plurality of toner images of different colors are deposited by electrostatics on the intermediate transfer belt in turn, the voltage which needs to be used to deposit the toner at a given printing station depends upon the voltage which is retained upon the belt surface and the toner deposited thereon at the preceding station or stations. Thus, as the belt progresses from one printing station to the next, the overall charge on the belt would tend to build up. If, as result of such a charge build-up, a discharge should take place between the belt and an imaging drum at one of these printing stations, or possibly between the belt and the transfer member, such a discharge would be liable to disturb the images on the belt. Thus, where several toner images are electrostatically deposited on the image carrying belt, charge on the belt can build up to the point where sparking or other uncontrolled discharge takes place, due to Paschen discharge where the image-carrying belt and the latent image carrier are being separated or are coming into contact with each other. By selecting the electrical properties of the image-carrying belt this excess charge is able to dissipate in a controlled manner between printing stations, the electrostatic voltages required for toner transfer at subsequent printing stations are thereby reduced and uncontrolled discharges are thereby avoided.

We are aware of U.S. Pat. No. 5,823,017 (Soga et al./Ricoh) which recommends the use of an intermediate transfer belt formed of a material having a volume resistivity of $10^8$ Ωcm to $10^{10}$ Ωcm ($10^6$ to $10^8$ Ωm), and a surface resistance of $10^7$ to $10^{13}$ Ω, in a printer of a configuration different to that of the present invention. According to column 11 lines 37 et seq. of this patent, a device for discharging the intermediate transfer belt is not necessary because such a belt can be easily discharged by a ground roller. It is stated that volume resistivities lower than $10^8$ Ωcm ($10^6$ Ωm) would prevent the toner image from being transferred to the belt while volume resistivities greater that $10^{10}$ Ωcm ($10^8$ Ωm) would result in the need for an extra discharging device in addition to the ground roller.

We have found that where the resistivity is too low, such as a volume resistivity of about $10^4$ ohm m or less, the image-carrying belt cannot sustain a charge sufficiently for efficient transfer of the toner image thereto. When the resistivity of the image carrying belt is too high, such as a volume resistivity of about $10^{13}$ ohm m or more, excess charges are not able to dissipate in a controlled manner and some discharge may occur.

The image-carrying belt is ideally formed of a single layer of the electrically non-conductive material, the mean volume resistivity being from $10^8$ to $10^{11}$ ohm m volume throughout the thickness of the belt.

In the present context, volume resistivity is measured according to ASTM D257. Preferably, the non-uniformity of the resistivity of the image-carrying belt is not more than ±1 order of magnitude.

It is desirable that the material of which the image-carrying belt is formed is ozone resistant. In the present context, ozone resistance is measured by the standard NEN-ISO 1431/1-1990, in which the sample is subjected to a tensile stress of 5 MPa in an atmosphere containing 5 ppm ozone at 55% relative humidity.

It is also desirable that the material of which the image-carrying belt is formed has a low moisture adsorption. If moisture is adsorbed onto the surface of the image-carrying belt, the electrical properties thereof can change and in particular the mean volume resistivity can fall. We prefer that the material of which the image-carrying belt is formed has mean volume resistivity of at least $10^8$ ohm m when measured in an atmosphere of 45% relative humidity. By using such a material, the need for extreme environmental conditioning measures to be taken in the printer is much reduced.

The surface of the image-carrying belt preferably has a hardness of at least 63 Shore D or equivalent. If the hardness is insufficient, the surface will be more susceptible to damage, e.g. by scratching.

The surface of the image-carrying belt, in contact with the image, preferably has a surface energy as low as possible to reduce the formation of toner filming and to reduce contamination from (sticky) components released by the printed substrates onto the surface of the transfer member. Most preferably, the image-carrying belt has a surface energy of less than 60 dynes/cm. Furthermore, a lower surface energy for the image-carrying belt is advantageous in maximizing the transfer efficiency and avoiding print defects in the transfer of the composite image to the transfer member.

Another important requirement with respect to the surface conditions is the roughness. The Ra-value for the surface of the image-carrying belt is preferably less than 0.5 $\mu$m to minimize the image noise and to maximize transfer efficiency.

The electrically non-conductive material from which the image-carrying belt is formed may be selected from within the classes of polyesters, polyethers, polyamides, polyimides and copolymers thereof. The material used can be homogeneous. Alternately, during the formation of the material, components can be added to modify the resistivity and/or the thermal properties and/or other properties of the material.

The image-carrying belt is preferably in the form of a non-woven continuous belt, especially a seamless belt, or a belt with a so-called invisible seam. Seamless belts may be formed by a centrifugal casting technique, as known in the art.

It is desirable that the material of which the image-carrying belt is formed is heat stable, that is the material can be melted and re-solidified without significant lasting chemical change occurring. With such heat stable materials the production of a seamless belt, or a belt having an "invisible" weld, is greatly facilitated. A seamless belt, or a belt with an invisible weld, is essential when the substrate is in the form of a web and the printer is intended to print images of indeterminate length.

The belt suitably has an average thickness of between 100 and 150 $\mu$m. If the thickness of the belt is too low, the stiffness is reduced making the belt vulnerable to deformations. If the thickness of the belt is too high, the stiffness and low transfer fields induce transfer defects such as voids and a loss of efficiency.

Ideally, the belt has a tensile modulus of greater than 0.5 Gpa, most preferably greater than 2 Gpa, as measured by ASTM D 790 IB. If the tensile modulus is too-low, it will result in registration problems between the individual toner images because relatively small tensile stress variations in the image-carrying belt can result in significant uncontrolled belt elongations between the toner image producing stations.

Also, the belt should have a tear resistance of at least 200 N/mm. If the tear resistance is too low the lifetime of the belt is decreased.

The following table illustrates some materials suitable for use as the image-carrying belt, together with some materials of similar composition of which some properties are not or improperly controlled, since they fail to meet one or more of the target characteristics. Characteristics are measured at a material thickness of 110 to 150 $\mu$m, at ambient temperature.

| TRADE NAME (SUPPLIER) | DESCRIPTION | VOLUME RESISTIVITY (Ωm) | HARDNESS | TENSILE MODULUS (GPa) |
|---|---|---|---|---|
| TARGETS | | $10^8$ to $10^{11}$ | | ≧0.5 |
| Hytrel 6356 (Dupont) | polyester | $9.7 \times 10^9$ | 63 Shore D | 0.33 |
| Hytrel 7246 (Dupont) | polyester | $1.8 \times 10^{10}$ | 72 Shore D | 0.57 |

-continued

| TRADE NAME (SUPPLIER) | DESCRIPTION | VOLUME RESISTIVITY (Ωm) | HARDNESS | TENSILE MODULUS (GPa) |
|---|---|---|---|---|
| Nylon 6 film AM301100 (Goodfellow, UK) | polyamide | $5 \times 10^{10}$ | Rockwell M82 | 2.8 |
| *Kapton XC (DuPont) | polyimide | $6 \times 10^5$ | Rockwell E52-99 | 3.4 |
| *Kapton HN (DuPont) | polyimide | $1.5 \times 10^{15}$ | Rockwell E52-99 | 2.5 |

*indicates a material of which the electrical properties are improperly controlled. Of the homogeneous materials, Hytrel 7246 is preferred, while of the electrically modified materials, polyimide is preferred.

Means for tensioning the image-carrying belt may be provided in order to ensure good registration of the toner images thereon and to improve the quality of transfer of the composite toner image therefrom to the transfer member. Means for controlling the transverse position and movement of the image-carrying belt may also be included.

Each toner image producing station may include a rotatable endless surface, such as a drum having a photosensitive surface, on which an electrostatic latent image is formed, a developing unit for developing the electrostatic image to form a toner image on the drum surface and means for transferring the toner image to the image-carrying belt. Each image producing station will generally include an electrostatic device for depositing the toner image on the image-carrying belt. The electrostatic device can be in the form of a transfer corona or a charged transfer roller. The image-carrying belt is preferably in contact with the drum over a wrapping angle of more than 5° so that adherent contact between the image-carrying belt and the drum surface enables drive to be reliably transmitted from the image-carrying belt to the drum. The reliability of this transfer is enhanced by tensioning the image-carrying belt.

The transfer member is provided for transferring the composite image from the image-carrying belt to a substrate. To achieve this, the composite image on the transfer member is heated to tackify the image before contact with the substrate. This heating may be achieved by heating the image directly, for example by use of a radiant heater positioned adjacent the surface of the transfer member, or indirectly, for example by heating the transfer member itself. Where the temperature of the composite toner image and the pressure exerted between the transfer member and the substrate at their region of contact are sufficient, no further fixing of the image on the substrate is required.

The transfer member may include an outer surface formed of a material having a low surface energy, for example silicone elastomer (surface energy typically 20 dyne/cm), polytetrafluoroethylene, polyfluoralkylene and other fluorinated polymers. The transfer member is preferably in a form having a low mass. For this reason, while the transfer member can be in the form of a transfer roller or drum, it is preferably in the form of a transfuse belt, for example an endless metal belt of 80 $\mu$m thickness coated with 40 $\mu$m thickness silicone rubber.

The transfer of the composite toner image from the image-carrying belt to the transfer member is more difficult to achieve if the transfer member has a relatively low surface energy. Therefor, it would be preferable to transfer the composite toner image from the image-carrying belt to the transfer member by electrostatic means.

Drive to the image-carrying belt is preferably derived from the drive means for the transfer member, by making use of adherent contact between the image-carrying belt and the transfer member causing the image-carrying belt and the transfer member to move in synchronism with each other. Adherent contact between the image-carrying belt and the image producing station drums may be used to ensure that the drums move in synchronism with the image-carrying belt. The image-carrying belt preferably passes over a guide roller positioned in opposition to the transfer member to form a first nip or contact region therebetween.

Means for cleaning the image-carrying belt are preferably provided after contact with the transfer member.

The transfer member may be positioned in opposition to a counter roller to form a second nip therebetween, through which the substrate path passes. After the transfer of the composite toner image therefrom, the transfer member is cooled, preferably forcibly, to lower the temperature of the transfer member to the optimum temperature for the transfer of further composite toner images thereto. Without such cooling, there is a risk that contamination originating from the substrate might transfer back to the image-carrying belt to disturb the performance of the latter. Furthermore, transfer defects can occur at the transfer between the image-carrying belt and the transfer member if the temperature is too high relative to the softening point of the toners. Although the image-carrying belt may be cleaned after its contact with the transfer member, higher temperatures are more likely to result in filming at the cleaning station.

Alternatively, the image-carrying belt may be separately driven which allows for a much smaller contact zone between the image-carrying belt and the heated transfer belt. As a consequence, there is less heat exchange between the two belts which allows at least for a less rigorous cooling of the transfer belt. Cooling of the transfer belt may even be omitted, particularly when using a heat stable image-carrying belt according to the present invention which assures that the volume resistivity of the belt remains in the range from $10^8$ to $10^{11}$ ohm m even when being exposed to heat in said contact zone. Furthermore, by using a belt with an average thickness in the range from 100 to 150 $\mu$m, belt deformation can be avoided in the contact zone with the heated transfer belt.

Where the temperature of the composite toner image and the pressure exerted between the transfer member and the substrate at the second nip are insufficient, means for further fixing and glossing of the image on the substrate may be provided downstream of the second nip.

The substrate may be in the form of a web, but the invention is equally applicable to substrates in sheet form, the device then being provided with suitable sheet feeding means. When the substrate is in the form of a web, web cutting means, optionally together with a sheet stacking device may be provided downstream of the second nip. Alternatively, the web is not cut into sheets, but wound onto a take-up roller. The web of substrate may be fed through the printer from a roll.

The printer according to the invention may also be part of an electrostatic copier, working on similar principles to those described above in connection with electrostatic printers. In copiers however, it is common to expose the rotatable endless surface exclusively by optical means, directly from the original image to be copied.

BRIEF DESCRIPTION OF THE DRAWING

The invention will be described in further detail, purely by way of example, with reference to the accompanying drawings, in which.

DETAILED DESCRIPTION

Figure 1:
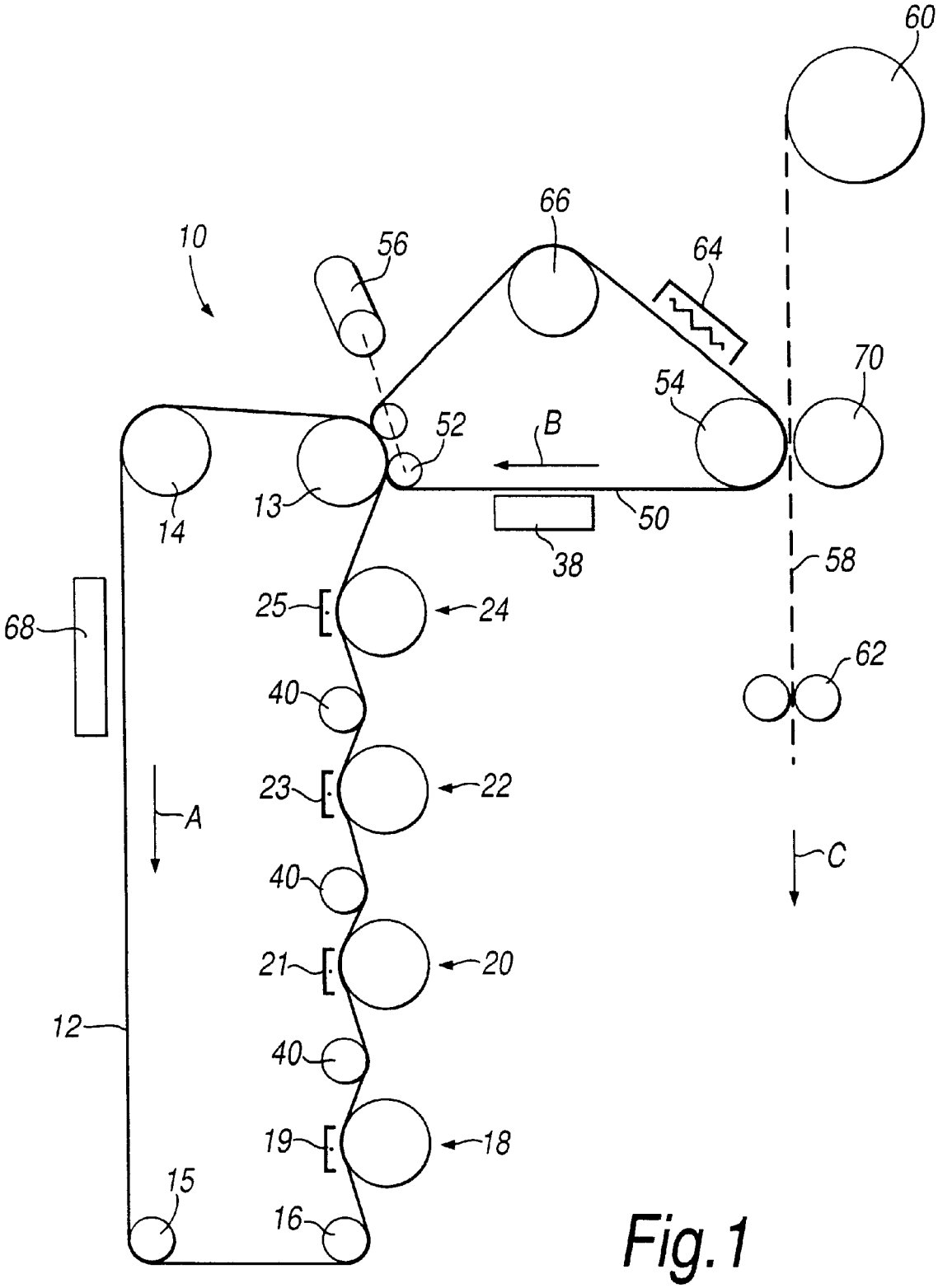
FIG. 1 shows a printer according to the invention.

FIG. 1 shows part of a single pass, multi-color electrostatographic printer 10. The printer includes a seamless image-carrying belt 12 which passes over a biased guide roller 13, and guide rollers 14, 15 and 16. The image-carrying belt 12 moves in a substantially vertical direction shown by the arrow A past a set of four toner image producing stations 18, 20, 22, 24. At the four toner image producing stations 18, 20, 22, 24, a plurality of toner images of different colors are transferred by transfer coronas 19, 21, 23, 25 or by means of transfer rollers to the image-carrying belt 12 in register with each other to form a first composite toner image, as described in more detail below with reference to FIG. 2, and as described in European patent application EP 629927 (Xeikon NV). These image producing stations may be similar to each other except in respect of the color of the toner with which they are supplied.

Figure 2:
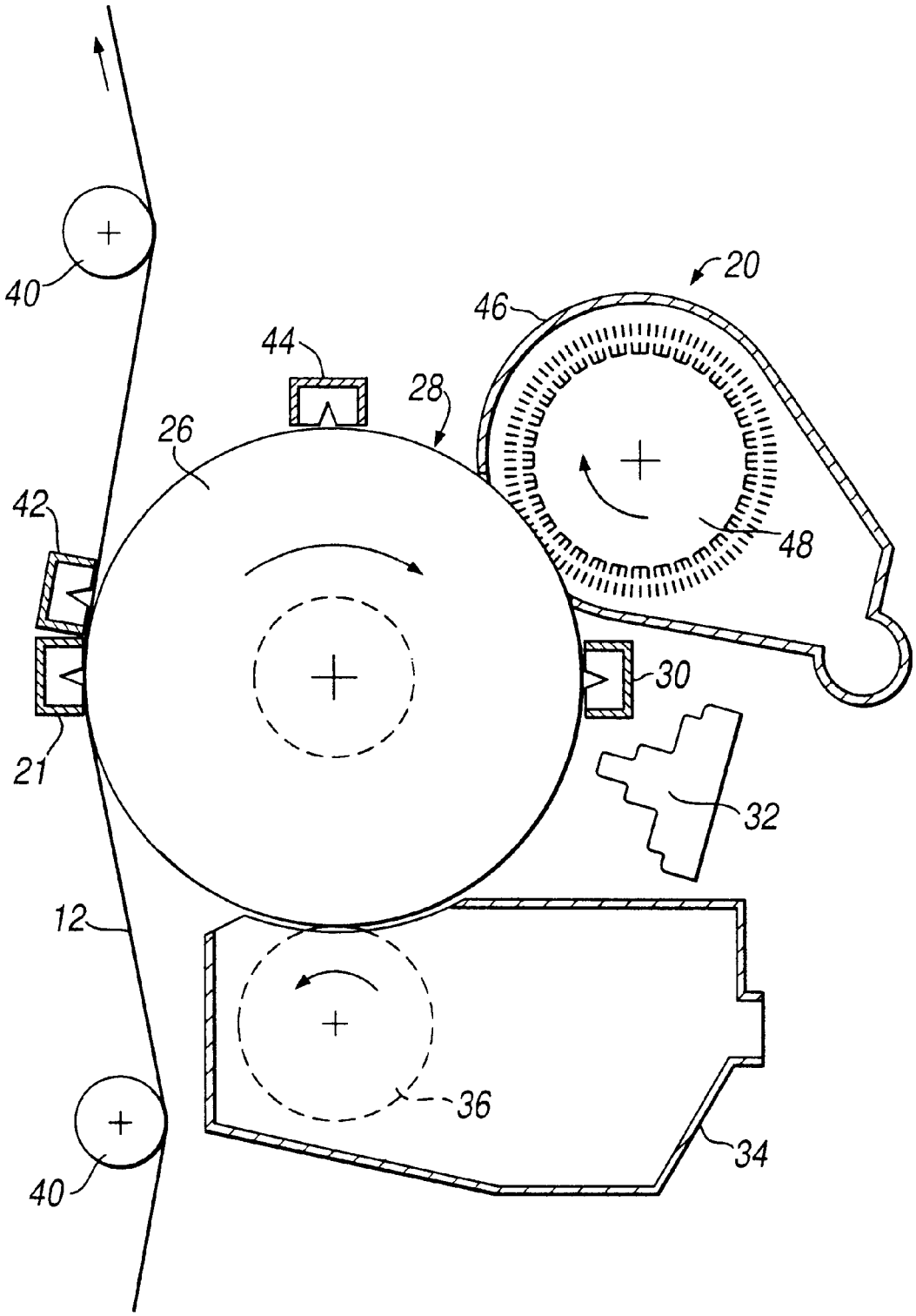
FIG. 2 shows details of one of the image-forming stations of the printer shown in FIG. 1.

As shown in FIG. 2, which shows for example the image producing station 20 of FIG. 1, each toner image producing station includes a cylindrical drum 26 having a photoconductive outer surface 28. Circumferentially arranged around the drum 26 there is a main corotron or scorotron charging device 30 capable of uniformly charging the drum surface 28, an exposure station 32 which may, for example, be in the form of a scanning laser beam or an LED array, which will image-wise and line-wise expose the photoconductive drum surface 28 causing the charge on the latter to be selectively reduced, leaving an image-wise distribution of electric charge to remain on the drum surface 28. This so-called "latent image" is rendered visible by a developing station 34 including a developer roll 36 which by means known in the art will bring a developer in contact with the drum surface 28. Negatively charged toner particles are attracted to the photo-exposed areas on the drum surface 28 by the electric field between these areas and the negatively electrically biased developer roll 36 so that the latent image becomes visible.

After development, the toner image adhering to the drum surface 28 is transferred to the moving image-carrying belt 12 by the transfer corona device 21. The moving image-carrying belt 12 is in face-to-face contact with the drum surface 28 over a small wrapping angle determined by the position of guide rollers 40. The charge sprayed by the transfer corona device 21, being on the opposite side of the image-carrying belt 12 to the drum, and having a polarity opposite in sign to that of the charge on the toner particles, attracts the toner particles away from the drum surface 28 and onto the surface of the image-carrying belt 12. The transfer corona device 21 also serves to generate a strong adherent force between the image-carrying belt 12 and the drum surface 28, causing the latter to be rotated in synchronism with the movement of the image-carrying belt 12 and urging the toner particles into firm contact with the surface of the image-carrying belt 12. The image-carrying belt 12, however, should not tend to wrap around the drum beyond the point dictated by the positioning of a guide roller 40 and there is therefore provided circumferentially beyond the transfer corona device 21 a belt discharge corona device 42 driven by alternating current and serving to discharge the image-carrying belt 12 and thereby allow the image-carrying belt 12 to become released from the drum surface 28. The belt discharge corona device 42 also serves to eliminate sparking as the image-carrying belt 12 leaves the surface 28 of the drum.

The moving image-carrying belt 12 is in face-to-face contact with the drum surface 28 as determined by the position of the guide rollers 13 and 16 and the intermediate guide rollers 40.

Thereafter, the drum surface 28 is pre-charged to a level of, for example −680 V, by a pre-charging corotron or scorotron device 44. The pre-charging makes the final charging by the corona 30 easier. Thereby, any residual toner which might still cling to the drum surface may be more easily removed by a cleaning unit 46 known in the art. Final traces of the preceding electrostatic image are erased by the corona 30. The cleaning unit 46 includes an adjustably mounted cleaning brush 48, the position of which can be adjusted towards or away from the drum surface 28 to ensure optimum cleaning. The cleaning brush 48 is earthed or subject to such a potential with respect to the drum as to attract the residual toner particles away from the drum surface. After cleaning, the drum surface is ready for another recording cycle.

In FIG. 1, a metal transfuse belt 50 is shown in contact with the image-carrying belt 12 downstream of the last image producing station 24. The transfuse belt 50 passes over an earthed guide roller 52 which is so positioned as to bring the transfuse belt 50 into contact with the toner image carrying belt 12 as it passes over the biased upper guide roller 13. The transfuse belt 50 also passes over a heated guide roller 54. The earthed guide roller 52 is driven by a master drive motor 56, in the direction of the arrow B. Drive is therefore transmitted in turn from the drive motor 56, via the transfuse belt 50 to the image-carrying belt 12 downstream of the toner image producing stations and to the toner image producing stations themselves.

The biased guide roller 13 and the transfuse belt 50 are positioned relative to each other to form a nip or contact region therebetween, through which the image-carrying belt 12 passes. Adherent contact between the image-carrying belt 12 and the transfuse belt 50 causes the image-carrying belt and the transfuse belt to move in synchronism with each other.

The composite toner image adhering to the surface of the image-carrying belt 12 is transferred to the moving transfuse belt 50 by establishing a voltage difference between the biased guide roller 13 and the earthed guide roller 52. The guide roller 13, having a polarity opposite in sign to that of the charge on the toner particles, repels the toner particles away from the image-carrying belt 12 and onto the surface of the transfuse belt 50.

After the transfer of the composite toner image thereto, the transfuse belt 50 passes an infra-red radiant heater 64 which raises the temperature of the toner particles to the optimum temperature for final transfer to the paper web 58. So as to ensure that the toner particles on the transfuse belt 50 are not subjected to sudden cooling as they reach the guide roller 54, the latter is heated.

After the transfer of the composite toner image therefrom, the transfuse belt 50 passes a forced cooling device 38, such as a device for directing cooled air onto the surface of the transfuse belt 50, to lower the temperature of the transfuse belt 50 to the optimum temperature for the transfer of further composite toner images thereto.

The transfuse belt 50 is tensioned by means of a spring loaded tensioning roller 66.

After contact of the transfuse belt 50, the image-carrying belt 12 passes a neutralizing and cleaning station 68, where residual toner is removed from the belt and any residual electrostatic charge thereon is neutralized.

A paper web 58 is unwound from a supply roll 60 and passes into the printer. The web passes in the direction of the arrow C to a pair of web drive rollers 62, driven by a slave motor (not shown). Tension in the web 58 is controlled by application of a brake applied to the supply roll 60. The guide roller 54 is positioned in opposition to a counter roller 70 to form a transfer nip or contact region therebetween, through which the paper web 58 passes. Thus the paper web 58 is brought into contact with the transfuse belt 50 whereby the composite toner image is transferred to one face of the paper web.

We are aware of European patent application EP 760495 (Canon) which describes the use of a contact transfer belt which has, for example, a single layer construction with a volume resistivity of $5\times10^{13}$ ohm.cm ($5\times10^{11}$ ohm.m) or a two-layer construction with a volume resistivity of $5\times10^{8}$ ohm.cm ($5\times10^{6}$ ohm.m) We are also aware of Japanese patent publications JP 11-024429 (Fuji-Xerox) and JP 8-202064 (Ricoh) the WPI abstracts of which both describe two-layer belts of unspecified thickness for use in sheet-fed printers.

Furthermore, U.S. Pat. No. 5,778,291 (Okubo et al./Fuji-Xerox) describes an image forming apparatus which includes an intermediate transfer belt having a volume resistivity of $10^{9}$ to $10^{12}$ ohm.cm ($10^{7}$ to $10^{10}$ ohm. m) with a thickness of up to 90 $\mu$m. Such a belt would be too thin to use in the context of the present invention leading to unacceptable deformation (creep) and damage while tension and alignment control devices would generate wrinkles and deformation in such a belt.

U.S. Pat. No. 5,438,398 (Tanigawa et al./Canon K K) discloses an image transfer member in the form of a hollow roller having a thick surface layer of elastomeric material having a volume resistivity of $10^{5}$ to $10^{11}$ ohm. cm ($10^{3}$ to $10^{9}$ ohm.m).

We claim:

1. A printer comprising an image-carrying member and a plurality of toner image producing stations for sequentially electrostatically transferring a plurality of toner images in register with each other to the surface of said image-carrying member to form a composite toner image thereon, wherein said image-carrying member with an average thickness in the range from 100 to 150 $\mu$m is formed of an electrically non-conductive material selected from the group of polyesters, polyethers, polyamides, polyimides and copolymers thereof, and having a mean volume resistivity of from $10^{8}$ to $10^{11}$ Ohm m.

2. A printer according to claim 1, wherein a non-uniformity of said resistivity is not more than one order of magnitude.

3. A printer according to claim 1, wherein said electrically non-conductive material is a homogeneous material.

4. A printer according to claim 1, wherein said image-carrying member is a seamless belt.

5. A printer according to claim 1, wherein said image-carrying member has a tensile modulus of greater than 0.5 GPa.

6. A printer according to claim 1, wherein said image-carrying member has a tear resistance of at least 200N/mm.

7. A printer according to claim 1, wherein said image-carrying member has a surface energy of less than 60 dynes/cm.

8. A printer according to claim 1, further comprising a transfer member for transferring said composite image from said image-carrying member to a substrate.

9. A printer according to claim 8, wherein said transfer member is a heated transfer belt.

10. A printer comprising an image-carrying member, a plurality of toner image producing stations for sequentially electrostatically transferring a plurality of toner images in register with each other to the surface of said image-carrying member to form a composite toner image thereon and a heated transfer belt whereto said composite image is transferred, wherein said image-carrying member with an average thickness in the range from 100 to 150 $\mu$m is formed of an electrically non-conductive material having a mean volume resistivity of from $10^8$ to $10^{11}$ Ohm m.

11. A printer according to claim 10, wherein said image-carrying member and said transfer belt are separately driven.

12. A printer according to claim 10, wherein said electrically non-conductive material is selected from the group of polyesters, polyethers, polyamides, polyimides and copolymers thereof.

* * * * *